US008047657B2

(12) United States Patent
Ikeda et al.

(10) Patent No.: US 8,047,657 B2
(45) Date of Patent: Nov. 1, 2011

(54) DISPLAY SHELF HAVING PLACING TABLES AND TRANSMISSION TYPE SCREENS AT FRONT OF PLACING TABLES

(75) Inventors: Yoshihiko Ikeda, Shizuoka-ken (JP); Hiroki Mochizuki, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/939,976

(22) Filed: Nov. 4, 2010

(65) Prior Publication Data

US 2011/0102750 A1 May 5, 2011

Related U.S. Application Data

(62) Division of application No. 11/899,374, filed on Sep. 5, 2007, now Pat. No. 7,832,874.

(30) Foreign Application Priority Data

Feb. 9, 2007 (JP) ..... 2007-030197

(51) Int. Cl.
*G03B 21/30* (2006.01)
*G03B 21/28* (2006.01)

(52) U.S. Cl. ..... 353/73; 353/74; 359/440; 359/460

(58) Field of Classification Search ..... 353/28, 353/74, 77, 78; 359/499, 449, 460, 900; 211/153; 340/572.1
See application file for complete search history.

(56) References Cited

U.S. PATENT DOCUMENTS

| | | | |
|---|---|---|---|
| 6,558,017 | B1 | 5/2003 | Saraiji et al. |
| 2006/0242981 | A1 | 11/2006 | Grassmuck et al. |
| 2007/0229767 | A1 | 10/2007 | Ikeda et al. |
| 2008/0055087 | A1 | 3/2008 | Horii et al. |
| 2008/0151197 | A1 | 6/2008 | Mochizuki et al. |
| 2008/0204672 | A1 | 8/2008 | Ikeda et al. |

FOREIGN PATENT DOCUMENTS

| | | | |
|---|---|---|---|
| DE | 10101030 | A1 * | 1/2001 |
| EP | 1839536 | | 10/2007 |
| JP | 07-017608 | | 1/1995 |
| JP | 07-231838 | | 9/1995 |
| JP | 09-285369 | | 11/1997 |
| JP | 2000-237011 | | 9/2000 |
| JP | 2001-245756 | | 9/2001 |
| JP | 2004-265185 | | 9/2004 |
| JP | 2005-099888 | | 4/2005 |
| JP | 2006-073384 | | 3/2006 |

OTHER PUBLICATIONS

Literature Reference: "A Display Shelf for Display," Nikkei industrial newspaper, compact edition, Nikkei Inc., Sep. 29, 2006, front page.
European Search Report dated Jun. 13, 2008, issued in counterpart European Application.
Japanese Office Action (and English translation thereof) dated Nov. 18, 2008, issued in a counterpart Japanese Application.
Japanese Office Action dated Mar. 2, 2009 (6 pages), and partial English translation thereof (3 pages) issued in counterpart Japanese Application No. 2007-030197.

* cited by examiner

*Primary Examiner* — Francis M Legasse, Jr.
(74) *Attorney, Agent, or Firm* — Patterson & Sheridan, LLP

(57) ABSTRACT

Screens are positioned at front areas of respective placing tables which form placing spaces for placing an article. Each of the screens is a transmission-type screen capable of transmitting projection image light projected on a back side of the screen. A first optical system and a second optical system are arranged inside the display shelf. The first optical system leads first partial image light, which is included in projection image light projected from a projector in the display shelf, to the back sides of the screens. And the second optical system leads second partial image light, which is included in the projection image light, to at least one of the placing spaces.

9 Claims, 11 Drawing Sheets

THE FIRST OPTICAL SYSTEM 23a ···21, 24(24a, 24b)
THE SECOND OPTICAL SYSTEM 23b···21, 22(22a, 22b)

THE FIRST OPTICAL SYSTEM 23a ···21, 24(24a, 24b), 22a
THE SECOND OPTICAL SYSTEM 23b···21, 22(22a, 22b, 22c, 22d)

DISPLAY SHELF HAVING PLACING TABLES AND TRANSMISSION TYPE SCREENS AT FRONT OF PLACING TABLES

CROSS-REFERENCE TO RELATED APPLICATION

The present application is a divisional of U.S. patent application Ser. No. 11/899,374, filed Sep. 5, 2007 now U.S. Pat. No. 7,832,874, which is based on and claims the benefit of priority of Japanese Patent Application P2007-030197 filed on Feb. 9, 2007, the entire contents of which are incorporated herein by reference.

BACKGROUND OF THE INVENTION

1. Field of the Invention

The present invention relates to a display shelf including transmission-type screen capable of transmitting a projection image light, which is projected on the screen, from a back side to a front side of the screen.

2. Discussion of Related Art

A display shelf is installed in a retail shop, such as a supermarket or a convenience store, to display articles. The displayed articles are illuminated so as to be found easily by customers.

For example, Japanese Laid-Open Publication No. 2000-237011 discloses a display shelf including a transparent synthetic resin cover around a light. The object of the invention of JP 2000-237011 is to prevent diffusion and diffused reflection of light for lighting the articles displayed on the display shelf.

In another example, Japanese Laid-Open Publication No. Hei 09-285369 discloses a display shelf including a tag holder and a panel. The tag holder holds a price card and so on. The panel, arranged below the tag holder, functions both as a shading visor and as a POP ("Point of Purchase") advertisement. The object of the invention of JP H09-285369 is to light up only the back side of the tag holder efficiently.

In a further example, Japanese Laid-Open Publication No. Hei 07-231838 discloses a display shelf including a light behind an information board semitransparent enough to transmit light. The object of the invention of JP H07-231838 is to light up both the information board and the displayed articles at the same time.

In each of the display shelves disclosed in Japanese Laid-Open Publication Nos. 2000-237011, Hei 09-285369 and Hei 07-231838, the light is arranged inside the placing tables or at the upper area of the placing tables, and the displayed articles are illuminated by the light. With this structure, however, when the light is arranged for the display shelf, electric wires of the light have to be hidden in the inside of the display shelf or behind the placing tables.

The object the present invention is to light articles displayed on the display shelf without electric wirings for supplying a light with electricity.

SUMMARY OF THE INVENTION

According to one aspect of the present invention, a display shelf includes: (i) a plurality of placing tables arranged at different heights, each of the placing tables forming a placing space for placing an article; (ii) a plurality of transmission-type screens, each of which is positioned at a front area of a corresponding one of the placing tables, and each of which transmits light projected on a back side of the screen; (iii) a projector placing part for arranging a projector which projects projection image light forming an image, (iv) a first optical system which leads first partial image light, which is included in the projection image light, to the back sides of the screens; and (v) a second optical system which leads second partial image light, which is included in the projection image light, to at least one of the placing spaces.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

The first embodiment of the present invention relates to a display shelf system 101 preferably used in a supermarket.

Figure 1:
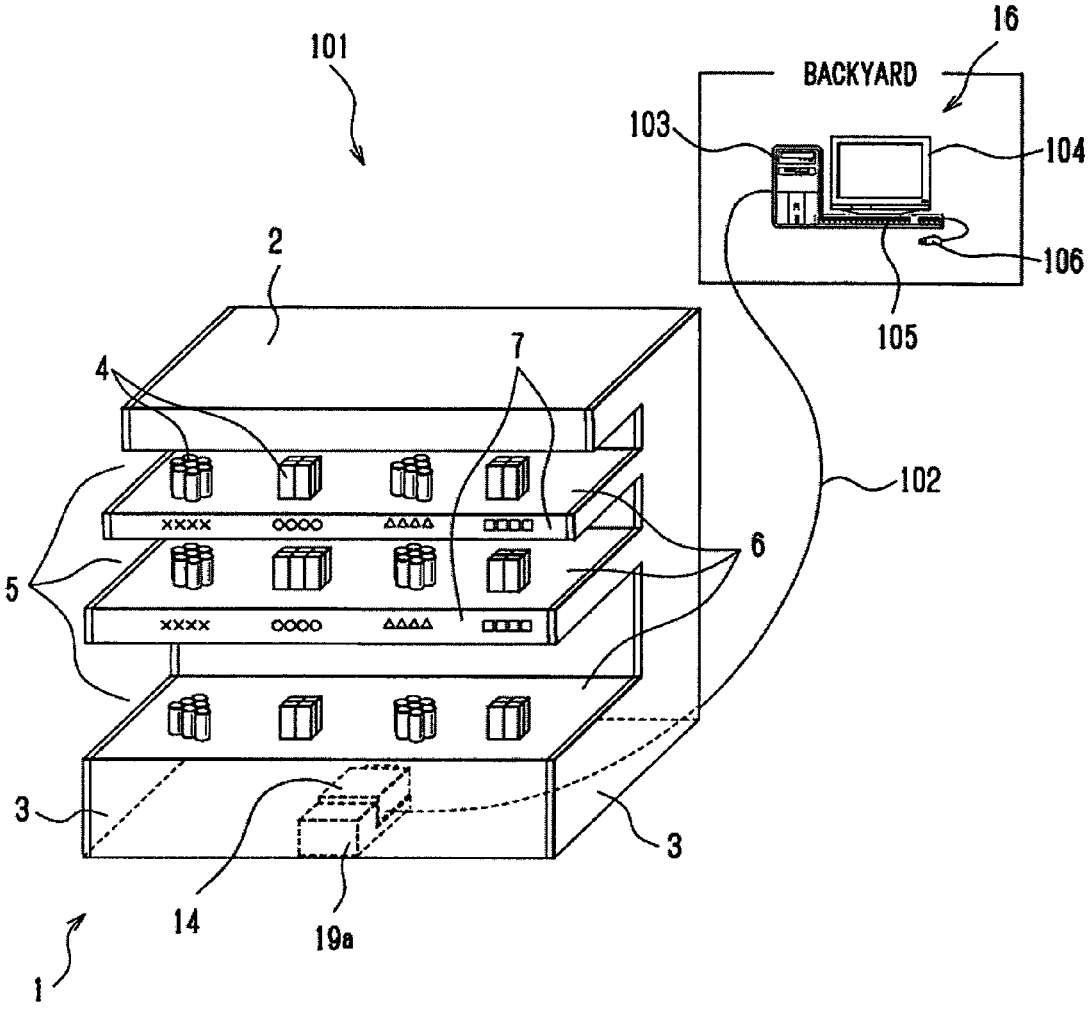
FIG. 1 is a schematic view showing a display shelf system of the first embodiment of the present invention.

FIG. 1 is a schematic view showing a display shelf system 101 of the first embodiment of the present invention. The display shelf system 101 includes a display shelf 1, a projector 14, and a computer 16. The display shelf 1 is placed in the store. The projector 14 is arranged inside of the display shelf 1. The computer 16 is located away from the display shelf 1, for example, in a stock room or another area away from the sales floor. The projector 14 and the computer 16 are connected via a network 102.

The display shelf 1 includes three placing tables 6. The three placing tables 6 are arranged to have a predetermined space therebetween in a height direction. Therefore, the three placing tables 6 are arranged at different heights.

Each of the three placing tables 6 is capable of supporting and displaying articles 4. In other words, each of the three placing tables 6 forms a placing space 5 above the placing table 6. Side surfaces of the three placing tables 6 are supported by a pair of side panels 3.

The display shelf 1 includes screens 7 corresponding to the placing tables 6 which are provided at a front area of the placing tables 6. Each of the placing tables 6 may have a screen 7 corresponding thereto, or one or more of the placing tables 6 may not have a screen 7 corresponding thereto. It is also possible to provide more screens 7 than placing tables 6. Each of the screens 7 extends downward from a front end of the corresponding placing table 6 and is tilted to face downward.

Each of the screens 7 includes a frosted glass structure, for instance, and is a transmission-type screen capable of transmitting and projecting projection image light from a back side to a front side thereof. Each of the screens 7 is formed to extend fully across a width of the placing tables 6 without a cut line. That is, each of the screens 7 is preferably formed by a single component (glass) and therefore does not include lines at which segments are joined.

The display shelf 1 includes a projector placing part 19*a* provided inside the display shelf 1. The projector placing part 19*a* arranges the projector 14 at a predetermined position.

Figure 3:
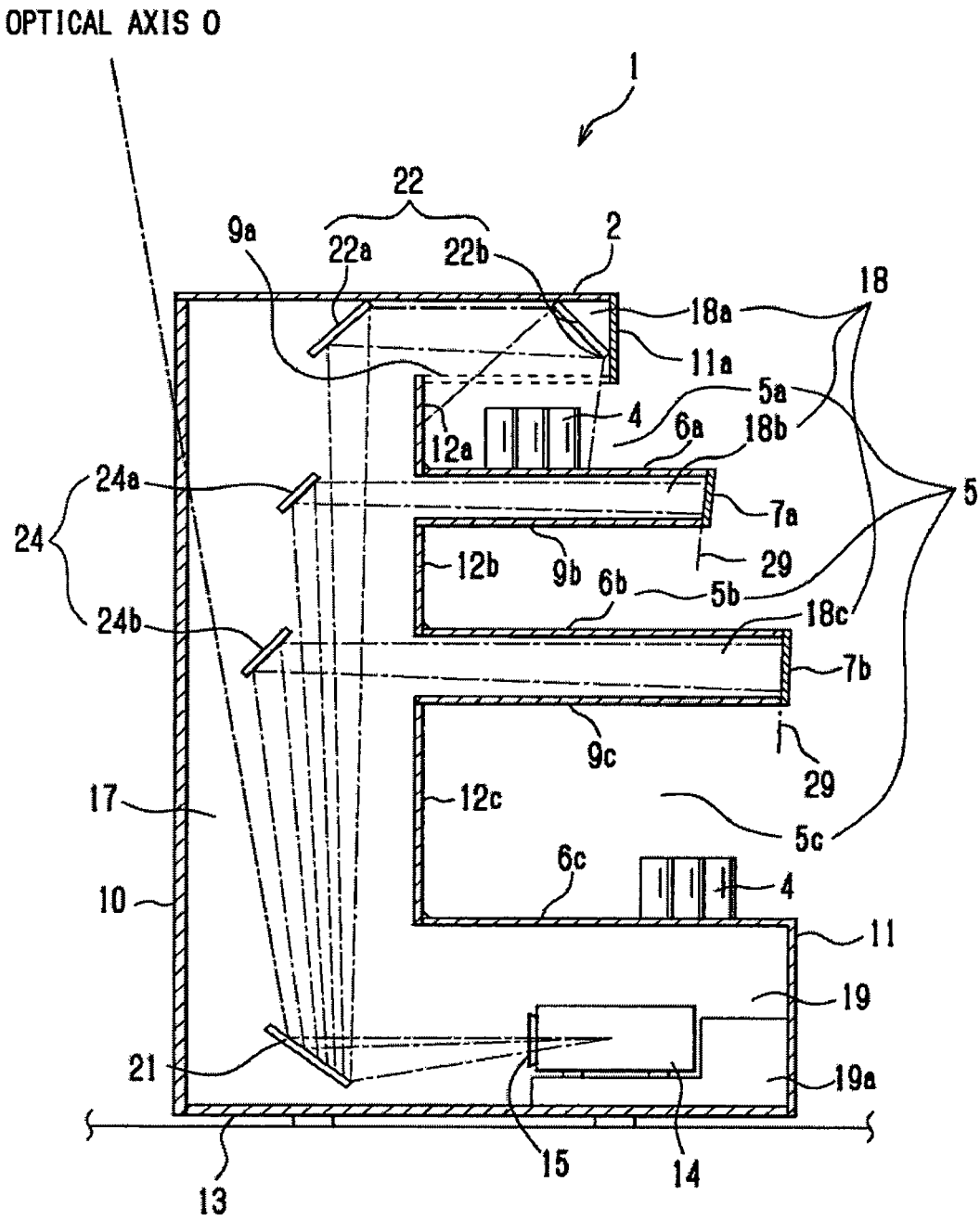
FIG. 3 is a side view in vertical section showing a display shelf of the first embodiment of the present invention.

The projector 14 includes a lens 15 (see FIG. 3). The projector 14 projects light of projection images through the lens 15. The projector 14 is a liquid crystal projector, for instance. The projector 14 is connected to the computer 16 via the network 102.

The computer 16 includes a body tower 103, a display 104, a keyboard 105, and a pointing device 106 such as a mouse and so on. The computer 16 manages image data which is a basis of the projection image light from the projector 14.

The projector 14 receives image data transmitted from the computer 16, generates projection image light based on the image data, and projects the projection image light through the lens 15 to the screens 7. The projection image light forms an image on the screens 7.

Figure 2:
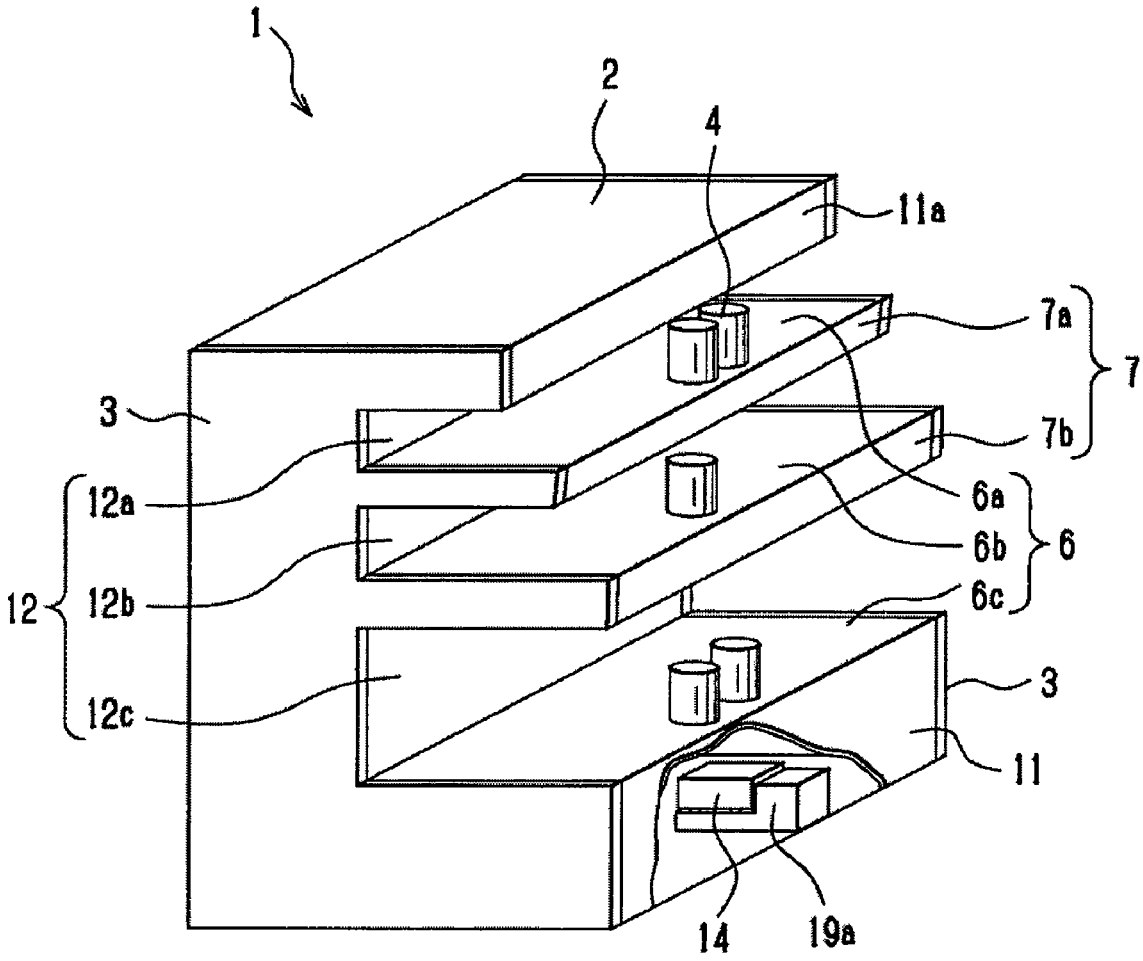
FIG. 2 is a perspective view showing a display shelf of the first embodiment of the present invention.

As shown in FIG. 2, the display shelf 1 includes a pair of side panels 3, a top panel 2, an upper front panel 11*a*, a backboard 10 (see FIG. 3), and a lower front panel 11. The top panel 2 is arranged horizontally at the top of the display shelf 1. The upper front panel 11*a* is arranged vertically in the front upper position of the display shelf 1. The upper side of the upper front panel 11*a* connects to the front end of the top panel 2. The lower front panel 11 is arranged vertically in the front lower position of the display shelf 1. The lower side of the lower front panel 11 touches the floor surface. The backboard 10 is arranged vertically on the back of the display shelf 1. The lower side of the backboard 10 touches the floor surface. The upper side of the backboard 10 connects to the top panel 2. The side panels 3 fixedly sandwich the top panel 2, the upper front panel 11*a*, the lower front panel 11, and the backboard 10.

The display shelf 1 includes three placing tables 6, namely a placing table 6*c* arranged at the lowest position, a placing table 6*b* arranged above the placing table 6*c*, and a placing table 6*a* arranged at the highest position. The placing tables 6*a*, 6*b*, 6*c* are sandwiched horizontally by the side panels 3 to be fixed. The placing tables 6*a*, 6*b*, 6*c* form placing spaces 5*a*, 5*b*, 5*c*, respectively, for placing and displaying articles 4.

The front end of the placing table 6*c* connects to the upper side of the lower front board 11. The screen 7*a* extends downward from the front end of the placing table 6*a*. The screen 7*b* extends downward from the front end of the placing table 6*b*. Side surfaces of the screens 7*a*, 7*b* are fixed by the side panels 3. A screen may also be provided to correspond to the placing table 6*c*, to extend downward from the front end of the placing table 6*c*.

Reflecting mirrors (described later) are arranged inside the display shelf 1. The reflecting mirrors form reflecting optical systems. In these reflecting optical systems, the liquid crystal display device provided in the projector 14 acts as an object surface. As explained below with respect to FIG. 3, each of the screens 7*a*, 7*b* is arranged at a position corresponding to image surface 29 (see FIG. 3) which is in a conjugate relationship with the liquid crystal display device.

A back panel 12*a* is arranged vertically at a back area of the placing table 6*a*. A back panel 12*b* is arranged vertically at a back area of the placing table 6*b*. A back panel 12*c* is arranged vertically at a back area of the placing table 6*c*. The back panels 12*a*, 12*b*, 12*c* (sometimes referred to herein as back panels 12) define the depths of the placing table 6*a*, 6*b*, 6*c* respectively.

A ceiling panel 9*b* constitutes a ceiling part of the placing table 6*b*. The back end of the ceiling panel 9*b* (see FIG. 3) connects to the top of the back panel 12*b*. The front end of the ceiling panel 9*b* connects to the bottom of the screen 7*a*. The ceiling panel 9*b* is arranged horizontally along a direction of the placing table 6*b*, without obstructing the projection image light from the projector 14.

A ceiling panel 9*c* constitutes a ceiling part of the placing table 6*c*. The back end of the ceiling panel 9*c* (see FIG. 3) connects to the top of the back panel 12*c*. The front end of the ceiling panel 9*c* connects to the bottom of the screen 7*b*. The ceiling panel 9*c* is arranged horizontally along a direction of the placing table 6*c*, without obstructing the projection image light from the projector 14.

At the top part of the back panel 12*a*, no ceiling panel is arranged. However, as shown with dotted lines in FIG. 3, a ceiling panel 9*a*, which is transparent enough to transmit projection image light, can be arranged horizontally as a ceiling part of the placing table 6*a*. The ceiling panel 9*a*, for instance, is made of a transparent acrylic board. In this case, the back end of the ceiling panel 9*a* connects to the back panel 12*a*, and the front end of the ceiling panel 9*a* connects to the upper front panel 11*a*.

As shown in FIG. 3, shelf image projecting spaces 18, including spaces 18*a*, 18*b* and 18*c*, which are flat and parallel to the placing tables 6 and the top panel 2, are formed inside the display shelf 1. The shelf image projecting space 18*a* is formed behind the upper front panel 11*a* and below the top panel 2. The shelf image projecting space 18*b* is formed behind the screen 7*a* and between the ceiling panel 9*b* and the placing table 6*a*. The shelf image projecting space 18*c* is formed behind the screen 7*b* and between the ceiling panel 9*c* and the placing table 6*b*.

A lower space 19 is formed inside the display shelf 1 below the placing table 6*c* and between the lower front panel 11 and the backboard 10.

A back image projecting space 17, which is spread out in a plane parallel to the backboard 10, is formed inside the display shelf 1 between the backboard 10 and the back panel 12.

In the lower space 19, the projector placing part 19*a* is provided on a bottom panel 13 which constitutes the bottom part of the display shelf 1. The projector placing part 19*a* has a structure capable of arranging the projector 14 so that the optical axis O of the projection image light from the projector 14 extends horizontally and backward in the display shelf 1.

Reflecting mirrors are arranged in the back image projecting space 17 and the lower space 19. These reflecting mirrors include a main mirror 21, two lighting mirrors 22 (22*a*, 22*b*), and two projecting mirrors 24 (24*a*, 24*b*). The main mirror 21 and the projecting mirrors 24*a*, 24*b* from a first optical system 23*a*. The main mirror 21 and the lighting mirrors 22*a*, 22*b* form a second optical system 23*b*.

The main mirror 21 is arranged in the lower space 19 and in a back position of the display shelf 1. The main mirror 21 is arranged at the height of the lens 15. The main mirror 21 is arranged so that it reflects the projection image light projected from the projector 14 and leads the light upward.

The projecting mirrors 24*a*, 24*b* are arranged in the back image projecting space 17 above the main mirror 21. The projecting mirror 24*a* corresponds to the screen 7*a*. The top of the projecting mirror 24*a* is arranged at the height of the top of the screen 7*a*. The projecting mirror 24*a* is arranged so that it reflects and leads the projection image light to the back side of the screen 7*a*. The projecting mirror 24*b* corresponds to the screen 7*b*. The top of the projecting mirror 24*b* is arranged at the height of the top of the screen 7*b*. The projecting mirror 24*b* is arranged so that it reflects and leads the projection image light to the back side of the screen 7*b*.

The lighting mirrors 22 include a lighting mirror 22*a* and a lighting mirror 22*b*. The lighting mirror 22*a* is arranged in the shelf image projecting space 18*a*. The top of the lighting mirror 22*a* is arranged at the height of the top panel 2. The lighting mirror 22*a* is arranged so that it reflects and leads the projection image light to the shelf image projecting space 18*a*. The lighting mirror 22*b* is arranged in the shelf image projecting space 18*a* in a front area of the shelf 1. The top of the lighting mirror 22*b* is arranged at the top panel 2. The lighting mirror 22*b* is arranged so that it reflects and leads the projection image light, which is led by the lighting mirror 22*a* to the shelf image projecting space 18*a*, to the placing space 5*a*.

Each of the main mirror 21, the lighting mirror 22*a* and the projecting mirrors 24 (24*a*, 24*b*) is a flat mirror capable of reflecting projection image light. The lighting mirror 22*b* is a convex mirror capable of reflecting projection image light.

The projecting mirrors 24*a*, 24*b* and the lighting mirror 22*a* are arranged at different positions in a front and rear direction of the display shelf 1 such that each of the mirrors 22*a*, 24*a* and 24*b* does not obstruct the projection image light projected from below to the other ones of the mirrors 22*a*, 24*a* and 24*b*.

Figure 4:
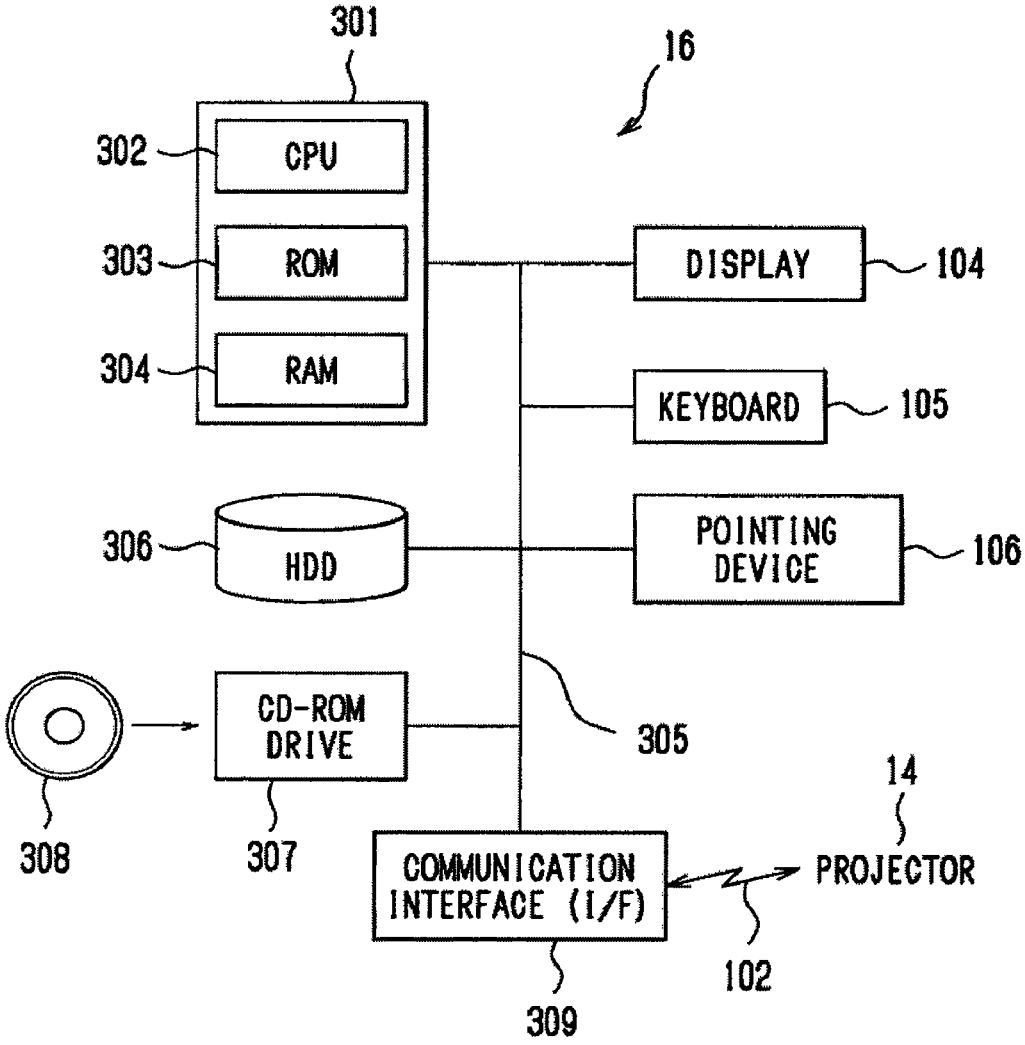
FIG. 4 is a block diagram showing a hardware structure of a computer of the first embodiment of the present invention.

FIG. 4 is a block diagram showing a hardware structure of a computer 16 according to the first embodiment of the present invention. As shown in FIG. 4, the computer 16 has a microcomputer 301 as an information processor. The microcomputer 301 includes a CPU 302, a ROM 303 and a RAM 304. The CPU 302 executes various processes. The ROM 303 fixedly stores data such as a BIOS and so on. The RAM 304, which is used as a work area, rewritably stores various variable data.

The microcomputer 301 is connected to a HDD 306 (Hard Disk Drive) and a CD-ROM drive 307 via a bus line 305 to enable free data communication. As an example, the CD-ROM drive 307 reads information from a CD-ROM 308 which stores an OS 310 (Operating System, See FIG. 5) and various application programs, and installs these information to the HDD 306.

Also, the display 104, the keyboard 105 and the pointing device 106 are connected to the microcomputer 301 via the bus line 305. The display 104 is an output device for outputting data from the microcomputer 301. The keyboard 105 and the pointing device 106 are input devices for inputting data to the microcomputer 301.

Further, the microcomputer 301 is connected to a communication interface (I/F) 309. The communication I/F 309 supports a protocol which enables communication between the microcomputer 301 and the projector 14 via the network 102.

Figure 5:
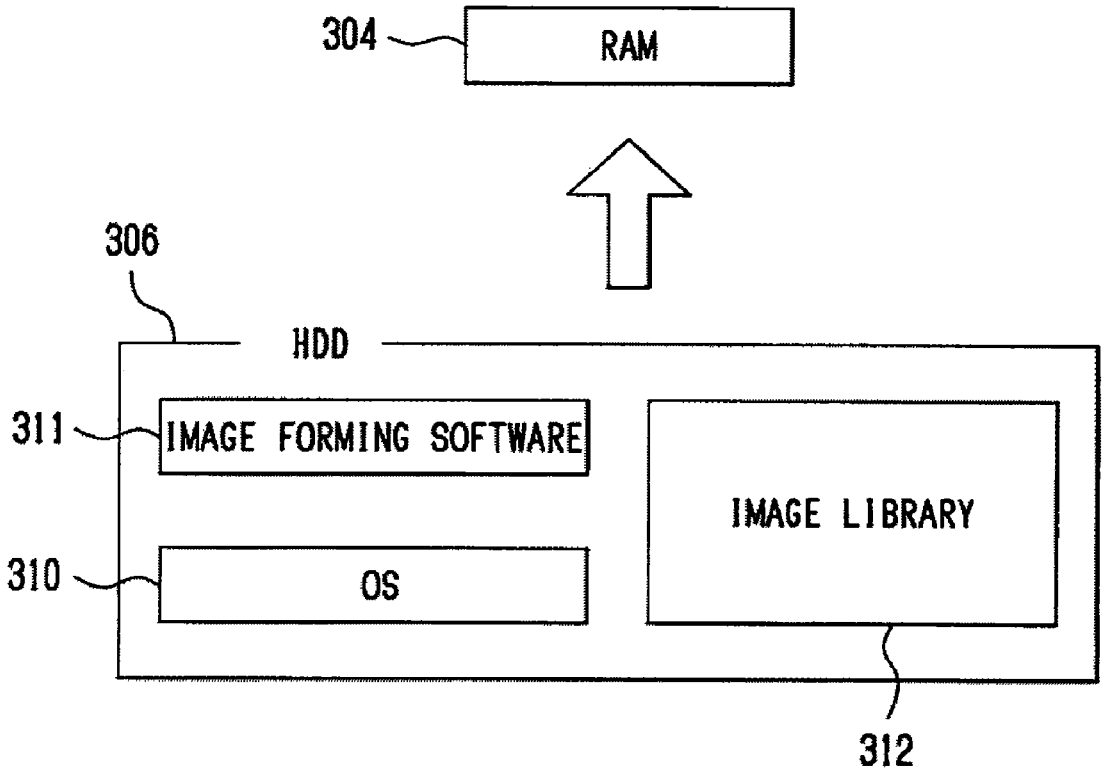
FIG. 5 is a block diagram showing a mechanism in the computer for editing and generating image data according to the first embodiment of the present invention.

FIG. 5 is a block diagram showing a mechanism in the computer 16 for editing and generating image data according to the first embodiment of the present invention. The computer 16 enables editing and generation of the image data. For such processes, image forming software 311 is installed in the HDD 306. The image forming software 311 is an application program which enables the computer 16 to edit and generate the image data that is a basis of the projection image light projected by the projector 14. In addition, the image library 312, which is used with the image forming software 311, is also installed in the HDD 306.

As for the image forming software 311, Microsoft PowerPoint (Product Name), for example, can be used to enable the computer 16 to edit and generate image data, and to overlay letters over the generated the image data. Further, during the editing and generating process of the image data, the image forming software 311 uses various model images included in the image library 312, and pastes them onto the generated image data. The image library 312 stores various photograph data and other images regarding foods and so on as model images.

All or a part of the image forming software 311 is copied into the RAM 304 when the image forming software is initiated to make the processes using on the image forming software 311 faster. Also, accompanying the copying of the image forming software 311 to the RAM 304, all or a part of the image library 312 is copied to the RAM 304 to make the process speed faster. Then, the microcomputer 301 transmits the image data edited and generated by the image forming software 311 from the communication I/F 309 to the projector 14 via the network 102.

Figure 6:
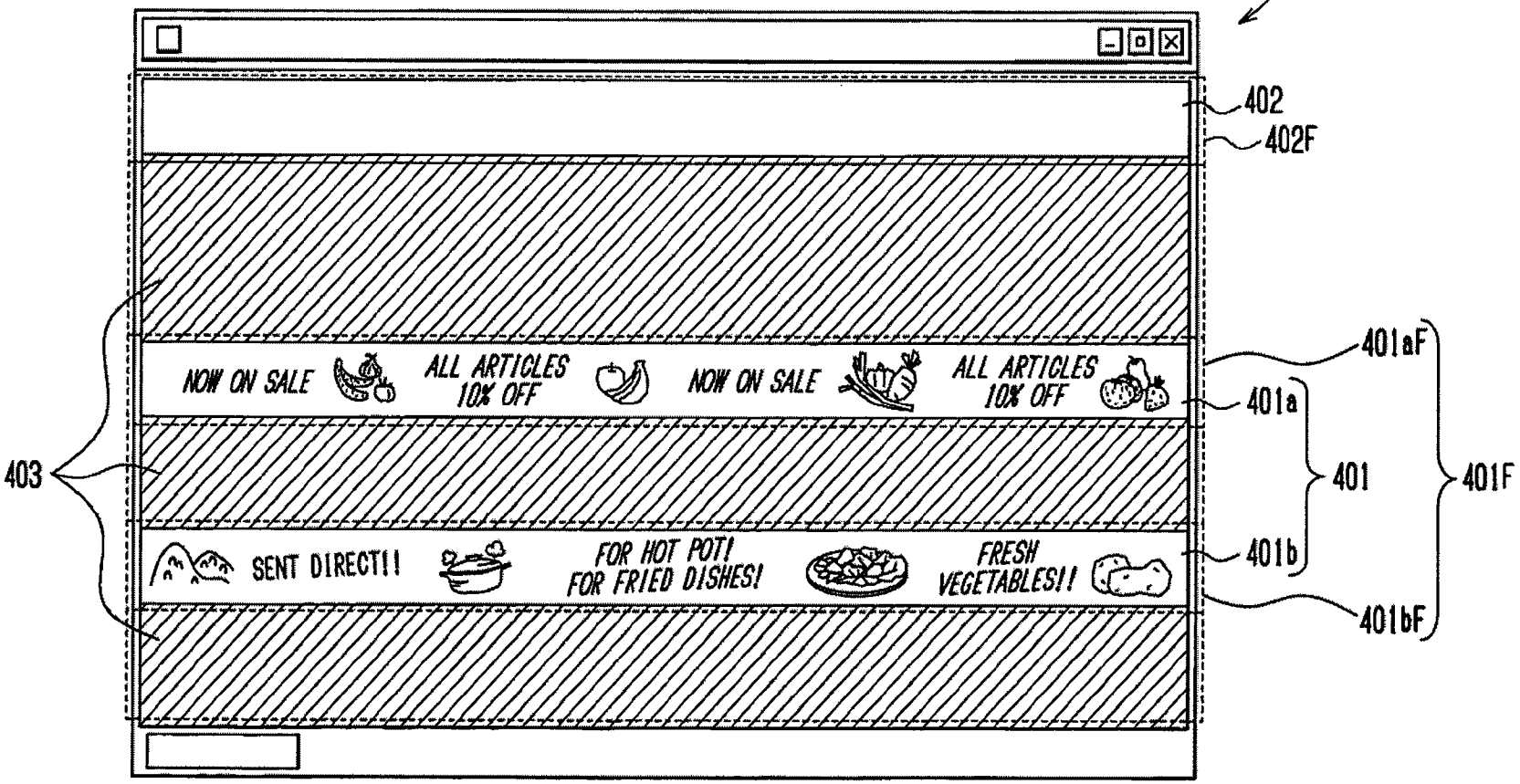
FIG. 6 is an illustrative view showing an example of the image data generated by the computer according to the first embodiment of the present invention.

FIG. 6 is an illustrative view showing an example of the image data generated by the computer 16 according to the first embodiment of the present invention. The image data 400 shown in FIG. 6 is illustrated as an image displayed on the display 104 of the computer 16.

The image data 400, as shown in FIG. 6, forms an image including a first area 401F, defined by first partial image data 401 of the image data 400, and a second area 402F, defined by second partial image data 402 of the image data 400. The first partial image data 401 is a basis of first partial image light, which is a part of the projection image light, that is led to the screens 7. The first area 401F has a first sub-area 401*a*F and a second sub-area 401*b*F. The first sub-area 401*a*F is belt-shaped and corresponds to the screen 7*a*. The first sub-area 401*a*F is defined by partial image data 401*a*, of the image data 400, corresponding to the screen 7*a*. The second sub-area 401*b*F is belt-shaped and corresponds to the screen 7*b*. The second sub-area 401*b*F is defined by partial image data 401*b*, of the image data 400, corresponding to the screen 7*b*. The first partial image data 401 is composed of, for instance, various model images regarding foods and POP-type letters, words and/or phrases. The first partial image data 401 is projected on the screens 7.

More specifically, the partial image data 401*a* is composed of, as shown in FIG. 6, letters, words, or phrases such as "NOW ON SALE" and "ALL ARTICLES 10% OFF", and model images regarding vegetables. These model images can be acquired from the image library 312. When the image forming software 311 is PowerPoint, for example, the model images can be projected with swing animation effect (animated to have a swing movement). The partial image data 401*b* is composed of, as shown in FIG. 6, letters, words, and/or phrases such as "SENT DIRECT!!", "FOR HOT POT! FOR FRIED DISHES!", and "FRESH VEGETABLES!!" and various model images. These various model images can be acquired from the image library 312, as well.

The second partial image data 402 is a basis of second partial image light, which is a part of the projection image light that is led to the placing spaces 5 (specifically, the placing space 5*a* according to the first embodiment). The second area 402F defined by the second partial image data 402 is belt-shaped and corresponds to the lighting mirror 22*b*. The second partial image data 402 is composed of an aggregate of white dots for instance, and is projected onto the lighting mirror 22*b* to be reflected to the placing space 5*a* according to the first embodiment.

The rest of the image data 400, which defines a third area 403 other than the first area 401F and the second area 402F, is blacked out.

The projector 14 arranged by the projector placing part 19*a* projects the projection image light backward and horizontally in the display shelf 1 (see FIG. 3). The first optical system 23*a* leads first partial image light, which is included in the projection image light, to the back sides of the screens 7*a*, 7*b*. The first partial image light forms images on the screens 7*a*, 7*b*. The second optical system 23*b* leads second partial image light, which is included in the projection image light, to the placing space 5*a*. The second partial image light acts as lighting for the displayed articles 4. Thus, a part of the projection image light acts as lighting for articles 4 displayed on the placing tables 6. Therefore, the display shelf 1 can illuminate articles displayed on the display shelf without a light which needs electric wirings.

More specifically, the projection image light is projected backward and horizontally from the projector 14, reflected upward by the main mirror 21, and led to each of the projecting mirrors 24*a*, 24*b* and the lighting mirror 22*a*. Each of the projecting mirrors 24*a*, 24*b* and the lighting mirror 22*a* is arranged so as not to obstruct the projection image light projected from below to the other ones of the mirrors 24*a*, 24*b* or 22*a*. Therefore, a portion of the projection image light is reflected by each of the projecting mirrors 24*a* and 24*b*. A part of the projection image light reflected by the projecting mirror 24*a* is led to the screen 7*a*. Another part of the projection image light reflected by the projecting mirror 24*b* is led to the screen 7*b*. The part of the projection image light led to the screens 7*a* and 7*b*, respectively, is transmitted and projected from the back sides of the screens 7*a*, 7*b* to the front sides. Since each of the screens 7*a*, 7*b* corresponds to the image surface 29 which is in a conjugate relationship with the liquid crystal display device in the projector 14, the projected image on the screen 7*a*, 7*b* is accurately in focus.

The first area 401F corresponds to the screens 7. So, when the model images and the letters to be projected on the screens 7 are composed inside the first area 401F corresponding to the first partial image data 401 of the image data 400 with the computer 16 and the first partial image data 401 is edited and generated, the first partial image light based on the first partial image data 401 is transmitted and projected on the front side of the screens 7. Thus, the display shelf 1 can show the first partial image data 401 as the information of the articles 4.

A part of the projection image light reflected by the lighting mirror 22*a* is led to the lighting mirror 22*b*. The part of the projection image light led to the lighting mirror 22*b* is reflected diffusely to the placing space 5*a*.

The second area 402F corresponds to the placing space 5*a*. So, when the second partial image data 402 of the image data 400 is edited and generated with the computer 16 in the second area 402F, the second partial image light based on the second partial image data 402 is led to the placing space 5*a*. Thus the display shelf 1 can use the second partial image data 402 as the lighting for the articles 4.

Figure 7:
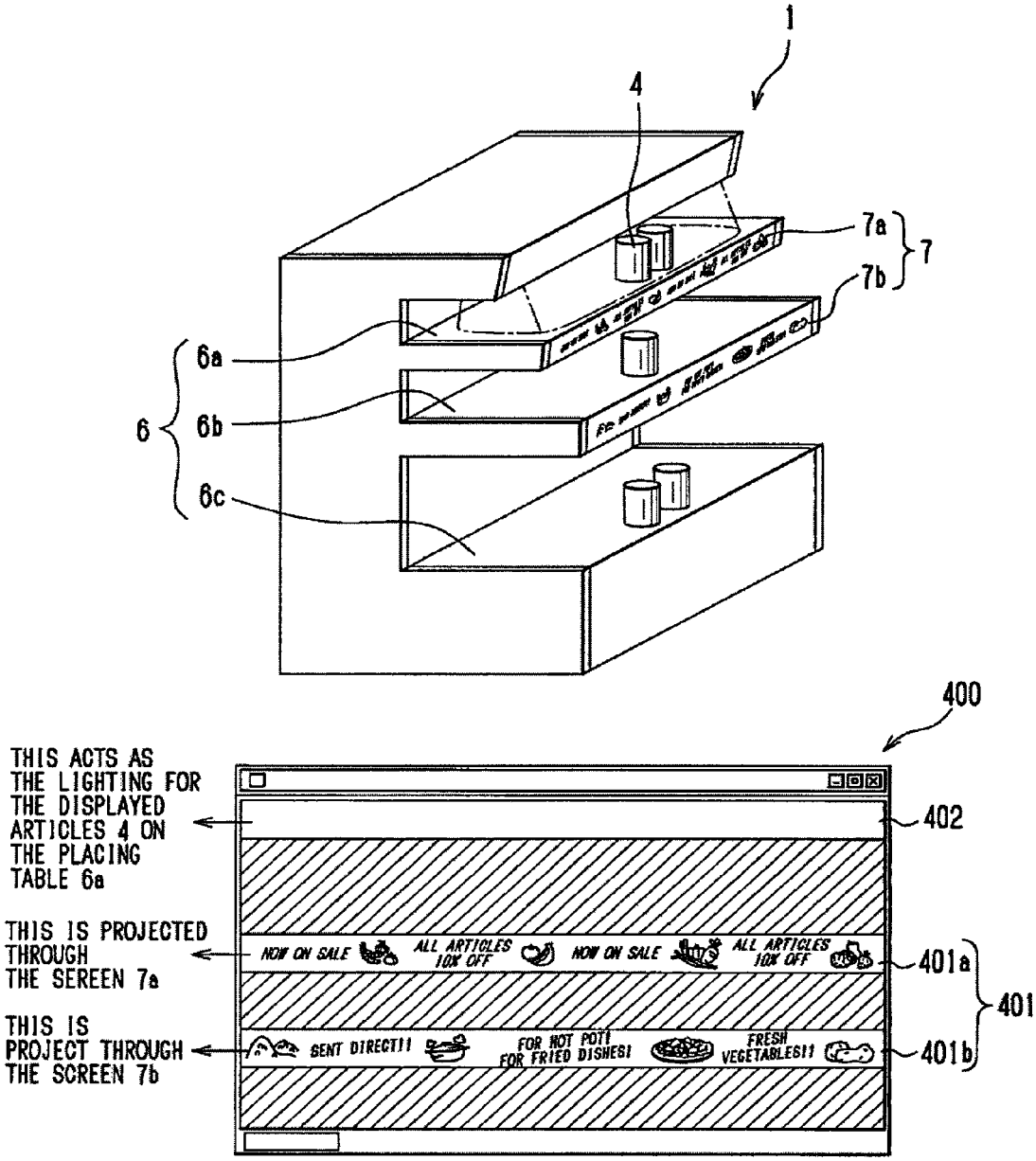
FIG. 7 is a schematic view show an example of the display shelf in operation according to the first embodiment of the present invention.

FIG. 7 is a schematic view showing an example of the display shelf 1 in operation according to the first embodiment of the present invention.

The computer 16 transmits the image data 400 including the images shown in FIG. 6 from the communication I/F 309 to the projector 14 via the network 102. For example, the image data 400 shown in FIG. 6 is edited and generated with the computer 16, the screen 7*a* shows the eye catcher, the screen 7*b* shows the information about the articles 4, and the articles 4 are illuminated.

That is, when the partial image data 401*a* is edited and generated in the first sub-area 401*a*F for a POP advertisement composed of POP letters, words and/or phrases, vegetable (for example) illustrations, and so on, with the computer, the screen 7*a* shows the POP advertisement as shown in FIG. 7. When the partial image data 401*b* is composed of the letters, words and/or phrases such as "SENT DIRECT!!", "FOR HOT POT! FOR FRIED DISHES!", and "FRESH VEGETABLES!!" in the second sub-area 401*b*F for information about the articles 4 with the computer 16, the screen 7*b* shows the information as shown in FIG. 7.

When the second partial image data 402 is composed of white dots in the second area 402F with the computer 16, the articles 4 placed on the placing table 6*a* are illuminated by the second partial image light based on the second partial image data 402, as shown in FIG. 7.

When the partial image data 401*a* has swing and scrolling animation effects, the pictures shown on the screens 7*a*, 7*b* swing and scroll.

Next, a second embodiment of the present invention will be explained with reference to FIGS. 8A and 8B. For the explanation of the second embodiment of the present invention, the structural elements that are the same as in the first embodiment will be assigned the same reference numbers and an explanation thereof will be omitted. Each of FIG. 8A and FIG. 8B is an illustrative view showing an example of the image data generated by the computer 16 according to the second embodiment of the present invention.

Figure 8:
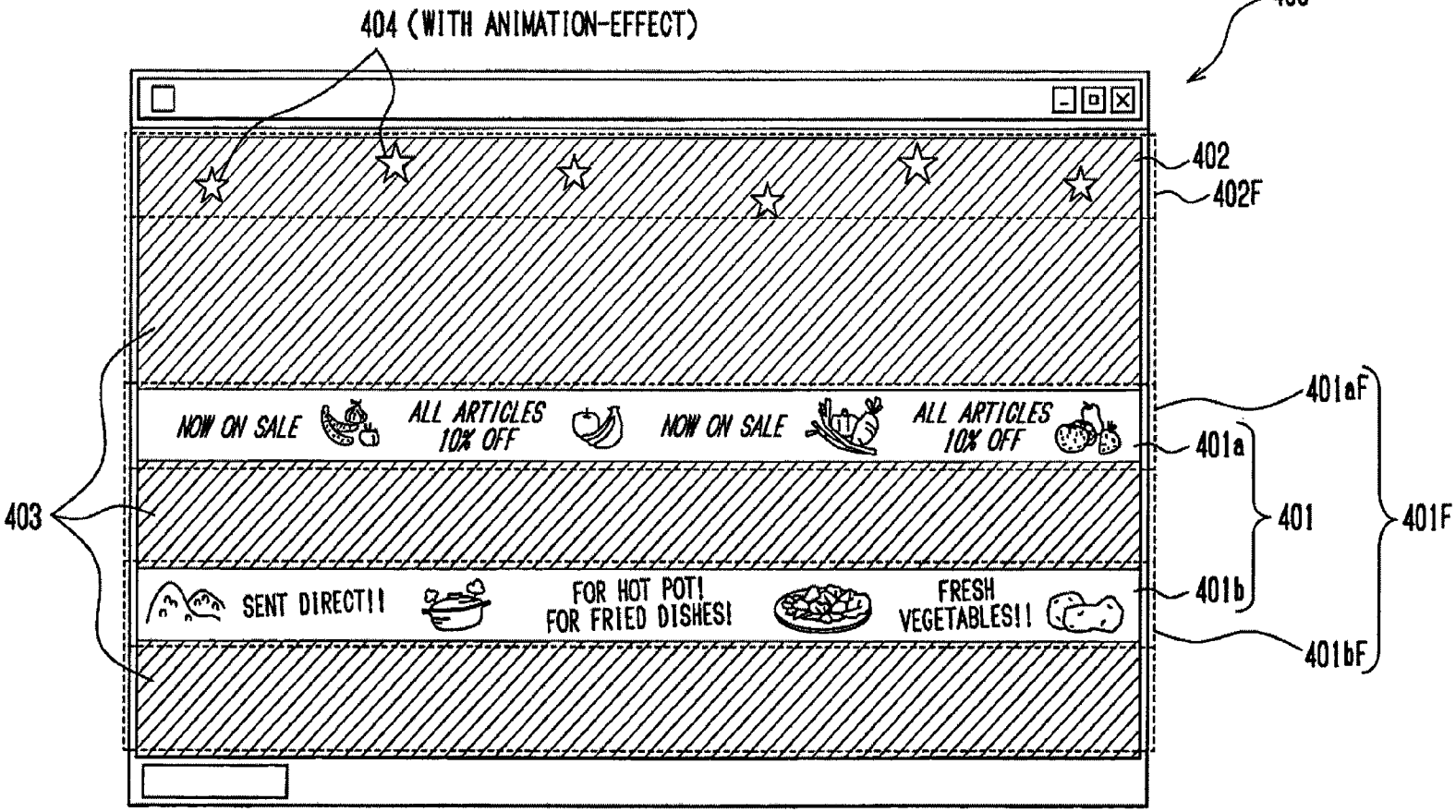
FIG. 8A is an illustrative view showing an example of the image data generated by the computer according to the second embodiment of the present invention and FIG. 8B is an illustrative view showing an example of the image data generated by the computer according to the second embodiment of the present invention.

In the second embodiment, as shown in FIG. 8A, the second partial image data 402 is composed of white star-shaped model images 404 with a parallel moving animation effect. Accordingly, the display shelf 1 can display an effect as if shooting stars were running on the surfaces of the displayed articles 4 placed on the placing table 6*a*.

Figure 8B:
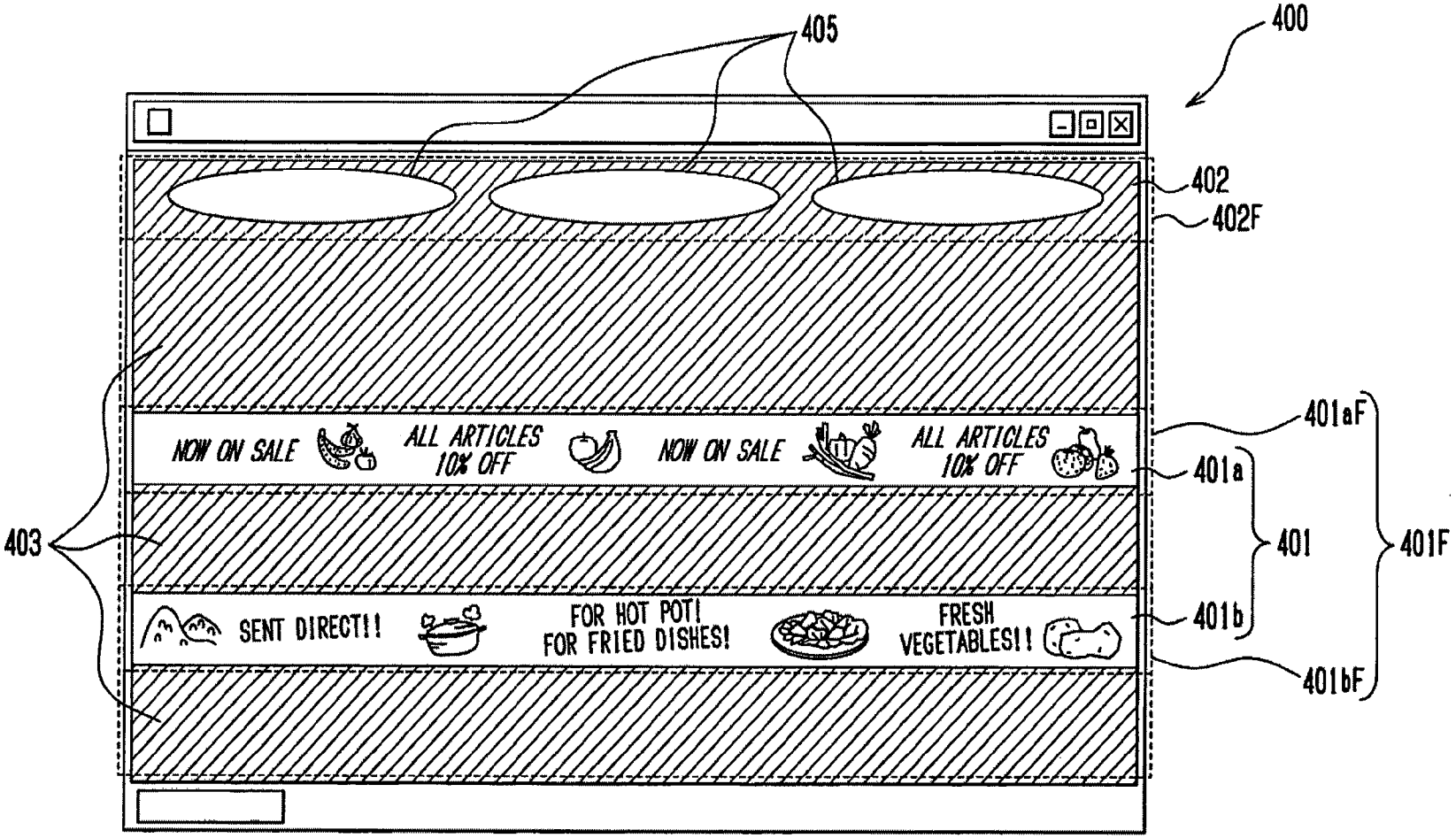

In a similar manner, as shown in FIG. 8B, the second partial image data 402 may be composed of white circles 405. With this structure, the display shelf 1 can highlight the specific articles 4 placed on the placing table 6*a* with spotlights.

Next, a third embodiment of the present invention will be explained with reference to FIGS. 9 and 10. For the explanation of the third embodiment of the present invention, the structural elements that are the same as in the first and the second embodiments will be assigned the same reference numbers and an explanation thereof will be omitted.

In the third embodiment, a further screen is provided and a part of the projection image reflected by one of the lighting mirrors is led to the further screen. In addition, in the third embodiment, another lighting mirror is added. This lighting mirror is arranged below the placing table 6*c* and leads the second partial image light upward from below the placing space.

Figure 9:
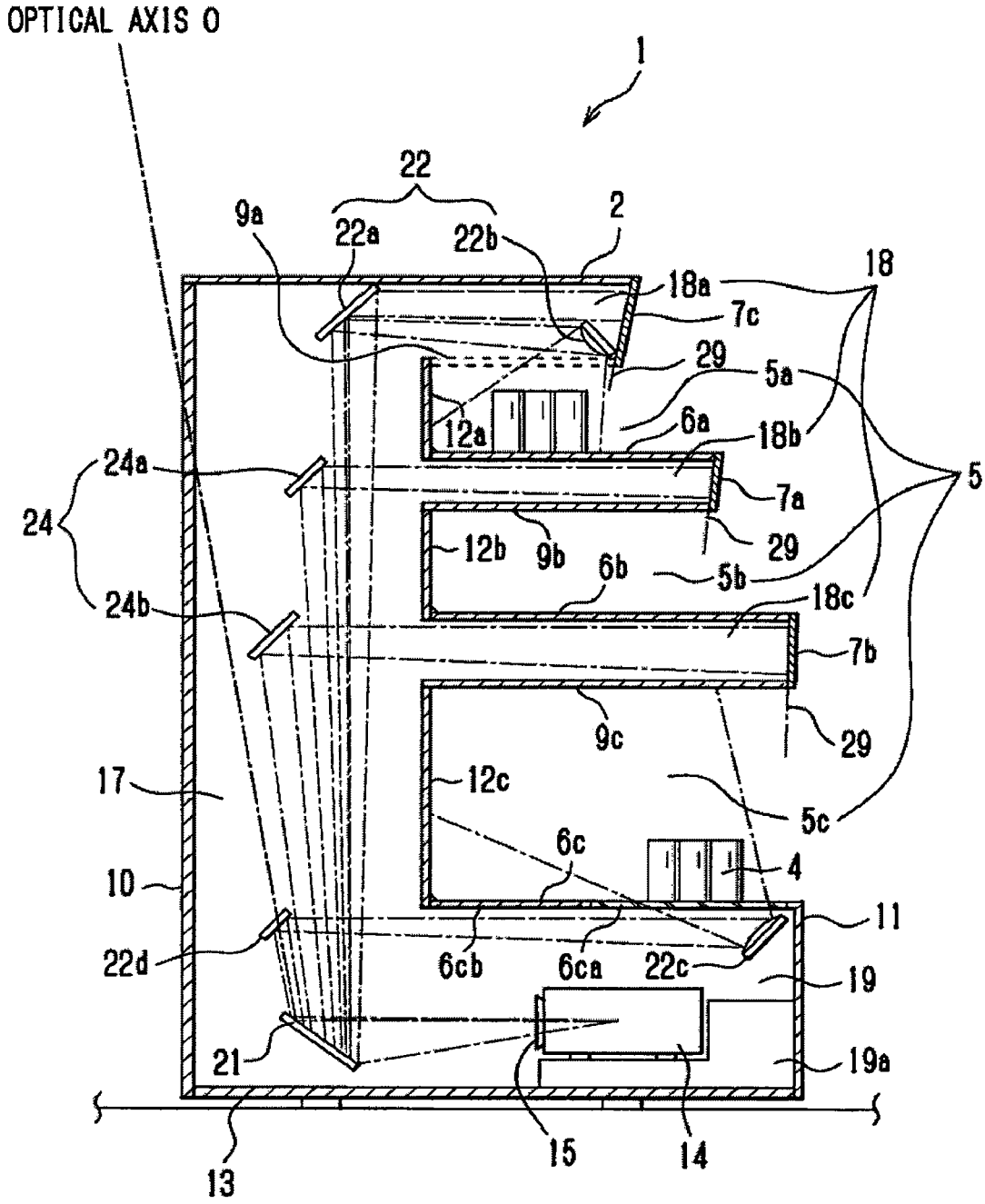
FIG. 9 is a side view in vertical section showing a display shelf of the third embodiment of the present invention.

FIG. 9 is a side view in vertical section showing a display shelf 1 of the third embodiment of the present invention.

The display shelf 1 includes a screen 7*c*, which extends downward from the front end of the top panel 2. In a similar manner to the screens 7*a*, 7*b*, 7*c* is arranged at a position corresponding to the image surface 29 which is in a conjugate relationship with the liquid crystal display of the projector 14.

According to the third embodiment, the lighting mirror 22*b* is about half the length as according to the first and the second embodiments. The lower half of the projection image light received by the lighting mirror 22*a* is reflected frontward by the lighting mirror 22*a*, and downward and backward by the lighting mirror 22*b*. The upper half of the projection image light received by the lighting mirror 22*a* is reflected by the lighting mirror 22*a*, led to the back side of the screen 7*c* and projected through to the front side of the screen 7*c*.

Thus, the lighting mirror 22*a* is a part of the first optical system 23*a* to lead the projection image light to the back side of the screen 7*c*, and is also a part of the second optical system 23*b* to lead the projection image light to the articles 4 displayed on the placing table 6*a*.

In addition, according to the third embodiment, the front of the placing table 6*c* is transparent enough to transmit the projection image light. For example, the front of the placing table 6*c* is made of a transparent acrylic board 6*ca*. The rear of the placing table 6*c* is opaque enough to obstruct the projection image light. For example, the rear of the placing table 6*c* is made of white opaque acrylic board 6*cb*. The placing table 6*c* is formed by the acrylic boards 6*ca*, 6*cb*.

A lighting mirror 22*c* is arranged in the lower space 19. The lighting mirror 22*c* is a convex mirror. The lighting mirror 22*c* is arranged with the mirror side thereof facing the articles displayed on the placing table 6*c*. The lighting mirror 22*c* leads diffuse light upward from below the placing space 5*c*.

A lighting mirror 22*d*, which is a flat mirror, is arranged in the lower space 19 and above the main mirror 21. The lighting mirror 22*d* leads a part of the projection image light reflected by the main mirror 21 to the lighting mirror 22*c*. The top of the lighting mirror 22*d* is at the height of the placing table 6*c*. Each of the lighting mirrors 22*d*, the projecting mirror 24*a*, 24*b* and the lighting mirror 22*a* does not obstruct the projection image light reflected and led to other ones of the mirrors 22*d*, 24*a*, 24*b* and 22*a* by the main mirror 21.

One side of each of the lighting mirrors 22*c*, 22*d* is capable of reflecting the projection image light. The lighting mirrors 22*c*, 22*d* are part of the second optical system 23*b* and lead the projection image light to the articles 4 displayed on the placing table 6*c*.

Figure 10:
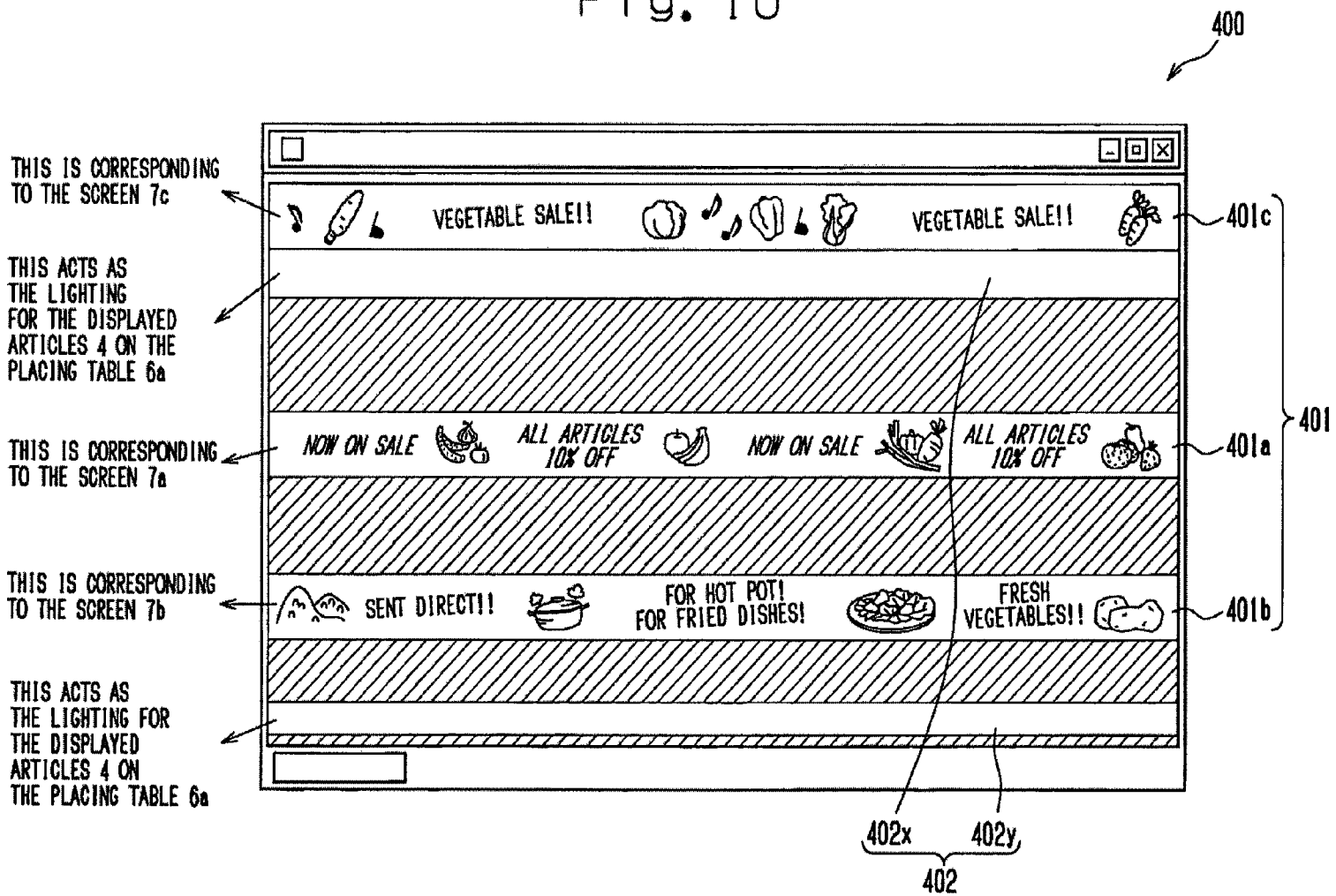
FIG. 10 is an illustrative view showing an example of the image data generated by the computer according to the third embodiment of the present invention.

FIG. 10 is an illustrative view showing an example of the image data generated by the computer 16 according to the third embodiment of the present invention.

In the image data 400, the partial image data 401*c* and the partial image data 402*x* are adjoining. The partial image data 401*c* corresponds to the screen 7*c*. The partial image data 402*x* is a basis of the lighting for the articles displayed on the placing table 6*a*. The image data 400 also includes the partial image data 402*y* which is a basis of the lighting of the placing space 5*c* above the placing table 6*c*.

In the third embodiment, the first optical system 23*a* leads the first partial image light (corresponding to partial image data 401*a*, 401*b* and 401*c*), which is included in the projection image light, to the back sides of the screens 7*a*, 7*b* and 7*c*. The second optical system 23*b* leads second partial image light (corresponding to the partial image data 402*x* and 402*y*), which is included in the projection image light, to the placing spaces 5*a* and 5*c*. The second partial image light acts as the lighting for the displayed articles 4. Thus, a part of the projection image light is used as the lighting for the articles 4 displayed on the placing tables 6. So, the display shelf 1 can light articles displayed on the display shelf without a light which needs electric wirings.

The screen 7*c* is arranged at the top part of the display shelf 1 so as to be noticed easily by customers. The screen 7*c* can perform sales promotion of the displayed articles 4 to customers staying away from the display shelf 1.

Further, the lighting mirrors 22*c*, 22*d* illuminate the displayed articles 4 from below. Therefore, the display shelf 1 of the third embodiment can light up the articles 4 in a different way from the first and the second embodiments.

Obviously, numerous modifications and variations of the present invention are possible in light of the above description of the present invention. It is therefore to be understood that within the scope of the appended claims, the invention may be practiced otherwise than as specifically described herein.

What is claimed is:

1. A display shelf comprising:

a plurality of placing tables arranged at different heights, each of the placing tables forming a placing space for placing an article;

a projector placing part provided in a lower space of the display shelf for arranging a projector which projects a beam of projection image light that forms an image;

a plurality of transmission-type screens which are positioned at front areas of the placing tables, and which transmit the beam of the projection image light;

a main lighting mirror which directs the beam of the projection image light upward;

a plurality of projecting mirrors, each of which is provided for a corresponding one of the placing tables, and each of which directs a portion of the beam of the projection image light to a back side of the screen positioned at a front area of the corresponding placing table;

a first lighting mirror which reflects a portion of the beam of the projection image light to produce a partial beam for lighting; and a second lighting mirror which receives the partial beam for lighting from the first lighting mirror and directs the partial beam for lighting to a placing space of one of the placing tables.

2. The display shelf according to claim 1, wherein the second lighting mirror is arranged above the placing space and directs the partial beam for lighting downward to the placing space.

3. The display shelf according to claim 1, wherein the second lighting mirror is arranged below the placing space and directs the partial beam for lighting upward to the placing space.

4. The display shelf according to claim 1, further comprising an additional second lighting mirror which receives the partial beam for lighting from the first lighting mirror and directs the partial beam for lighting to a placing space of another one of the placing tables, wherein one of the second lighting mirrors is arranged above the placing space to which the partial beam for lighting is directed and directs the partial beam for lighting downward to the placing space, and another of the second lighting mirrors is arranged below the placing space to which the partial beam for lighting is directed and directs the partial beam for lighting upward to the placing space.

5. The display shelf according to claim 1, wherein the second lighting mirror comprises a diffusing optical system which directs the partial beam for lighting to the placing space diffusely.

6. The display shelf according to claim 2, wherein the second lighting mirror comprises a diffusing optical system which directs the partial beam for lighting to the placing space diffusely.

7. The display shelf according to claim 2, wherein the second lighting mirror is arranged under a top panel of the display shelf to lead the partial beam for lighting downward to the placing space of the placing table arranged at the highest position relative to the other placing tables.

8. The display shelf according to claim 3, wherein the second lighting mirror comprises a diffusing optical system which directs the partial beam for lighting to the placing space diffusely.

9. The display shelf according to claim 4, wherein each of the second lighting mirrors comprises a diffusing optical system which directs the partial beam for lighting to the corresponding placing space diffusely.

* * * * *